United States Patent [19]

Thibaudon

[11] 4,049,999

[45] Sept. 20, 1977

[54] SPEED CONTROL SYSTEM FOR A CHAIRLIFT

[75] Inventor: Bruno Thibaudon, St. Nizier du Moucherotte, France

[73] Assignee: Pomagalski S.A., France

[21] Appl. No.: 710,328

[22] Filed: July 30, 1976

[30] Foreign Application Priority Data

Aug. 14, 1975 France ..... 75.25465

[51] Int. Cl.[2] ..... B61B 10/02; H02P 7/04

[52] U.S. Cl. ..... 318/305; 318/163; 318/446; 104/178

[58] Field of Search ..... 104/173 ST, 178, 173 R; 187/39; 198/854, 322; 318/162–164, 305, 308, 322, 446, 484, 498

[56] References Cited

U.S. PATENT DOCUMENTS

| | | | |
|---|---|---|---|
| 2,949,178 | 8/1960 | Fabula | 198/322 |
| 3,190,646 | 6/1965 | Forsman | 104/173 ST |
| 3,573,582 | 4/1971 | Petrocelli | 318/305 |
| 4,003,314 | 1/1977 | Pearson | 104/173 ST |

*Primary Examiner*—Robert K. Schaefer
*Assistant Examiner*—Michael K. Mutter
*Attorney, Agent, or Firm*—Stevens, Davis, Miller & Mosher

[57] ABSTRACT

A speed control system for a chairlift which reproduces automatically at the arrival of a seat in the disembarking station the speed which this seat had in the embarking station. The speed information is applied to a shift-register or a magnetic recorder which restores this information to control the speed at the arrival.

5 Claims, 3 Drawing Figures

OUTPUT
stage 1
stage 2
ON
OFF
MOTOR
REDUC
AND
SHIFT REGISTER
P1
P2
G1
G2

SPEED CONTROL SYSTEM FOR A CHAIRLIFT

The invention relates to a speed control system for a chairlift and, more particularly, to such a system in which any one of a number of different velocities may be selected by a manual speed selector.

The chairlift operator selects a low speed when a foot-passenger or an inexperienced skier embarks and thereafter a high-speed to provide attractive transport capacities. At arrival of the seat carrying the foot-passenger the speed should again be reduced to facilitate disembarking. This conventional system requires an operator in the arrival station to control the deceleration or to signal the arrival of a seat transporting a foot-passenger or a sightseer.

It is an object of the present invention to provide a speed control system wherein the velocity of a seat at the departure terminal is automatically reproduced at the arrival terminal.

Another object of the invention is to provide a chairlift control system having a high degree of reliability and controlled by a single operator.

According to a feature of the invention, a switch is actuated by each seat passing at the departure terminal to produce pulse signals, the frequency of which representing the velocity of the chairlift. The seats are regularly staggered along the chairlift cable and an electronic counter of shift register counts the number of pulses given by the switch. The register further acts as a storage device of the speed information in the departure terminal and this information is restored after a predetermined number of pulses, corresponding to the movement of the seat from the departure terminal to the arrival terminal. The number of counting stages of the shift register substantially corresponds to the number of seats disposed along the cable between the departure and arrival stations.

It is another object of the invention to provide a control system which can easily be adapted to a conventional chairlift.

These and other objects and advantages of the invention will become apparent from the following description of two embodiments which are shown in the accompanying drawings, wherein.

Figures 1, 2, 3:
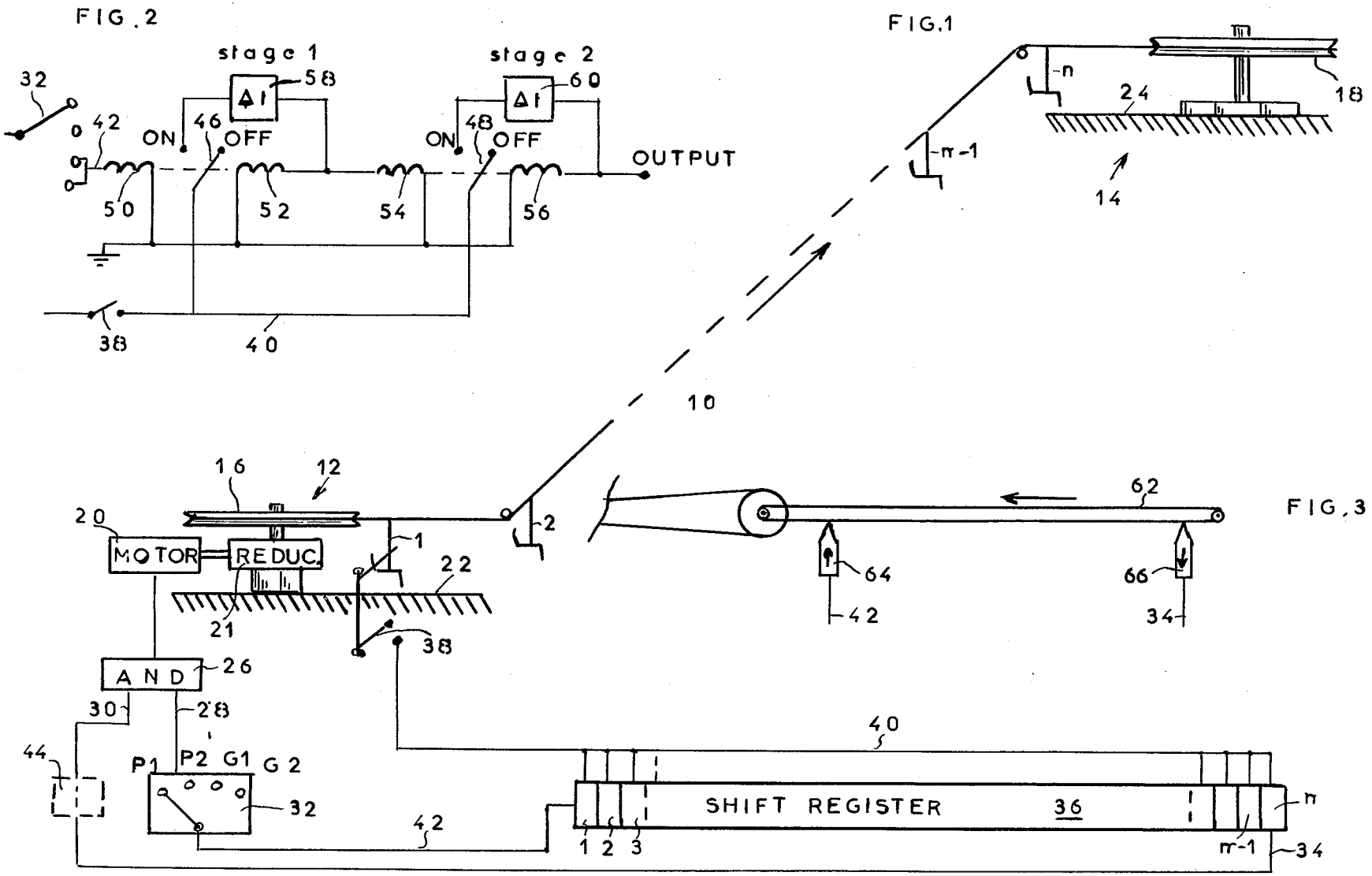
FIG. 1 shows the block diagram of a speed control system for a chairlift.
FIG. 2 shows some circuit details of a shift register which forms part of FIG. 1.
FIG. 3 shows schematically an embodiment of the invention.

A cable 10 of a chairlift extends between a downhill terminal 12 and an uphill terminal 14 and passes over terminal return sheaves 16, 18. An electric drive motor 20 is arranged to rotate the return sheave 16 by means of a mechanical speed reductor 21. Seats 1, 2 . . . $n-1$, $n$ are regularly disposed along the cable 10 and pass through the terminals 12, 14 at stations 22, 24, at which skiers or foot-passengers may embark and disembark. The other cable strand (not shown) passes in a similar manner through embarking and disembarking stations respectively in the uphill 14 and downhill terminals 12.

The motor 20 is electrically connected to a speed control device 26 having two inputs, one receiving an input signal on line 28 from a manual four point selector switch 32, and the other receiving a signal on line 30 from the output 34 of a shift register 36. An electrical switch 38 is disposed at the embarking station 22 and is actuated by each seat to provide a pulse signal on line 40 by each passage of a seat. The shift register 36 comprises $n$ stages, the number $n$ corresponding to the $n$ seats disposed between the stations 22, 24. Each stage 1 to $n$ of shift register 36 receives an input shift signal on line 40, derived from the passage of a seat. A speed information signal, derived from the position of selector switch 32, is applied via line 42 at the input of stage 1.

As indicated in FIG. 1, the speed selector switch 32 provides manual selection of four speeds, for instance two high speeds $G_1$, $G_2$, respectively of 2 and 2,5 meter/sec, and two low speeds $P_1$, $P_2$, respectively of 1 and 1,5 meter/sec. The shift register 36 receives via line 42 a low speed or high speed signal respectively in the positions $P_1$, $P_2$, and $G_1$, $G_2$, of selector 32, and this speed information is restored at the arrival of the seat to control the speed of motor 20 for instance for a chairlift speed of 1,5 meter/sec. and 2,5 meter/sec. Of course, the selector switch 32 may have only two points, one corresponding to low speed of 1,5 meter/sec and the other to high speed of 2,5 meter/sec, or more points.

The operation of the speed control system is as follows:

The selector switch 32 is for instance on point $P_1$ and seat 1 passes at low speed at departure station 22 to embark a foot-passenger. A low-speed signal defined as 0 signal appears on line 42 and this 0 signal is shifted to stage 2 of the shift register 36 when the seat 1 actuates the switch 38 and applies a shift pulse to shift register 36. At each passage of a seat this 0 signal is shifted one stage further and it is restored at output 34 of stage $n$ when the seat enters the arrival terminal 14. The speed control device 26 receives via line 30 this low-speed signal and is arranged to provide a low-speed signal if any one of its inputs receives a low-speed signal. It will be seen that the low speed is automatically reproduced at the arrival of the seat whatever the position of selector 32 at this time. A high speed is reproduced in the same manner.

The shift register is a conventional unit and in FIG. 2 is shown a shift register where two bi-stable devices 1, 2, called stages, are shown symbolically as electrically operated two-position switches 46, 48. Coils 50, 52 and 54, 56 operate the switches 46, 48 in the "On " and respectively in the "Off " position. A time delay device 58, 60 applies the shift signal received on line 40 on coils 52, 54 when switch 46 is "On" and on coil 56 and output of stage 2 when switch 48 is "On". Line 42 is connected to coil 50 and the coil 54 is connected to the output of stage 1. Normally both switches 46, 48 are in the "Off" position as shown and "shift" pulses cannot appear on the output terminals. When a signal high speed appears on line 42, the speed selector 32 being for instance in position $G_1$, the action of coil 50 throws switch 46 to "On". At the passage of the seat a shift pulse occurs on line 40 and is connected by switch 46 to delay device 58. The delayed pulse applied to coil 52 returns switch 46 to "Off" if in the meantime the selector switch 32 is returned to low speed; and applied to coil 54 turns switch 48 to "On". At the next passage a second shift pulse occurs and the high-speed signal appears at the stage 2 output. It is clear that the device performs a delay action on the input pulse which corresponds to the number of stages of the shift register and thus to the numbers of seats on the line of the chairlift.

If the selector switch 32 is a two point selector for a low-speed and a high-speed selection, the control device 26 comprises a conventional AND gate which supplies a high-speed logic signal only if the signal provided by switch selector 32 and the signal provided by shift register 36 are both high-speed signals. A low-speed signal overrides always a high-speed signal. The speed control signal operates a conventional speed regulator for instance an electrical pole changing relay.

The system is arranged to command and begin a speed reduction before the seat arrives at the debarking point to allow an appropriate deceleration. A time delay device 44, shown in dotted lines in FIG. 1, permits a regulation of the delay of application of the shift register output signal to the control device 26 in accordance with the structure of the chairlift.

The same control system may be used for passengers embarking at the uphill station 14 to reproduce the speed on arrival at the downhill station 12.

Various configurations of the operating circuit are possible and FIG. 3 illustrates a simplified embodiment comprising a magnetic recorder. The movement of a magnetic tape 62 is synchronized with the movement of the chairlift cable 10 and a magnetic recording head 64 and a magnetic reproducing head 66 are spaced along the tape 62 a distance corresponding to the distance between the embarking and disembarking stations 22, 24. The recording head 64 receives via line 42 the selected speed signal for recording on tape 62. This stored signal is reproduced when the impressed tape length passes on the magnetic reproducing head 66 at the time of the entrance of the seat in the arrival terminal 24, to control the speed of the chairlift in the abovementionned manner.

What is claimed is:

1. A speed control system for a chairlift having seats hung from an endless cable extending between an embarking station and a disembarking station comprising:

a motor for driving said cable means for changing the speed of the motor means for detecting the speed at the passage of a seat in the embarking station a storage device for storing the speed information received from said detecting means and for restoring this speed information at the arrival of said seat in the disembarking station to automatically reproduce at the arrival the speed of the seat at the departure.

2. A speed control system as claimed in claim 1, comprising:

a manual operable speed selector for changing the speed of the motor, the selected speeds being subdivided into two groups respectively the low-speed and the high-speed group, means for detecting the position of said speed selector at the passage of a seat in the embarking station and producing a logic signal of low speed or high speed, a shift register for storing this logic signal and restoring the signal at the arrival of the seat in the disembarking station.

3. A speed control system as claimed in claim 2, comprising:

means for detecting the passage of a seat and for producing a pulse signal at each passage, means for supplying said pulse signals to said shift register to shift the register of one stage at each passage of a seat, the number of stages of the shift register substantially corresponding to the number of seats disposed between the embarking and disembarking stations.

4. A speed control system as claimed in claim 1, comprising means for supplying with an adjustable delay said restored speed information to said motor speed changing means.

5. A speed control system as claimed in claim 1, comprising:

a recorder having a recording medium for storing said speed information, a recording head and a reproducing head, means for moving the recording medium in synchronism with said cable, the distance between the recording head and the reproducing head corresponding to the distance between the embarking station and the disembarking station such that a speed information recorded at the passage of a seat in the embarking station is reproduced at the passage of this seat in the disembarking station.

* * * * *